US011572689B1

(12) United States Patent
Moses

(10) Patent No.: US 11,572,689 B1
(45) Date of Patent: Feb. 7, 2023

(54) DECORATIVE SLEEVE FOR WOODEN BEAM

(71) Applicant: Thomas Fredrick Moses, Victorville, CA (US)

(72) Inventor: Thomas Fredrick Moses, Victorville, CA (US)

( * ) Notice: Subject to any disclaimer, the term of this patent is extended or adjusted under 35 U.S.C. 154(b) by 0 days.

(21) Appl. No.: 17/705,046

(22) Filed: Mar. 25, 2022

Related U.S. Application Data

(60) Provisional application No. 63/165,580, filed on Mar. 24, 2021.

(51) Int. Cl.
*E04B 1/64* (2006.01)
*E04B 1/26* (2006.01)

(52) U.S. Cl.
CPC ..... *E04B 1/64* (2013.01); *E04B 1/2604* (2013.01)

(58) Field of Classification Search
CPC ..... E04B 1/64; E04B 1/2604
See application file for complete search history.

(56) References Cited

U.S. PATENT DOCUMENTS 3,300,940 A * 1/1967 Golasz ..... E04B 9/005 52/843
3,994,104 A * 11/1976 Gurrola ..... E04D 3/30 52/22
4,866,901 A * 9/1989 Sanchez ..... E04G 23/02 52/514
6,782,666 B1 * 8/2004 Condon ..... E04D 13/158 52/93.2
6,829,862 B1 * 12/2004 Skulsky ..... E04F 19/02 52/287.1
6,918,213 B2 * 7/2005 Burkart ..... B29C 33/444 52/93.2
7,076,923 B2 * 7/2006 Seldon ..... E04D 13/0722 52/93.2
7,165,372 B1 * 1/2007 Skulsky ..... B44C 5/00 52/27
8,640,420 B1 * 2/2014 Halley ..... E04F 10/08 52/650.1
2003/0041531 A1 * 3/2003 Seldon ..... E04D 13/158 248/48.1
2004/0139664 A1 * 7/2004 Burkart ..... C08G 18/4018 52/94
2005/0257464 A1 * 11/2005 Skulsky ..... E04F 10/08 52/311.1
2007/0227080 A1 * 10/2007 Tseng ..... E04F 10/08 52/78

* cited by examiner

*Primary Examiner* — Rodney Mintz
(74) *Attorney, Agent, or Firm* — Plager Schack LLP; Mark H. Plager; Naomi Mann

(57) ABSTRACT

A decorative and/or protective sleeve configured to cover a wooden beam includes a textured decorative surface, and an opening through which the beam may be inserted. The sleeve may have a faux wood surface texture to provide a fresh wood appearance and may further protect the beam from damage.

9 Claims, 3 Drawing Sheets

DECORATIVE SLEEVE FOR WOODEN BEAM

RELATED APPLICATION

This application claims benefit to U.S. Provisional Application No. 63/165,580 filed on Mar. 24, 2021, which is incorporated by reference herein in its entirety.

BACKGROUND

The embodiments herein relate generally to systems for protecting and enhancing the appearance of a home or other structure, and more particularly to systems for protecting and enhancing the exterior appearance of a structure such as a beam.

Wooden beam(s), which may be an exterior component of a residential home or other structure, may tend to rot or otherwise wear over time. This may degrade the appearance of the home. As such, a system which addresses this problem is desirable.

SUMMARY

According to various embodiments, disclosed is a decorative and/or protective sleeve, configured to cover a wooden beam. In embodiments, the decorative sleeve may have a faux wood surface texture to enhance the appearance of the beam and may further protect the beam from damage. The sleeve may be provided as a single component covering that may entirely encase the exposed exterior of the beam. In some embodiments, the sleeve may be made of a waterproof material such as polyurethane. As such, the disclosed sleeve may enhance and/or restore the cosmetic appearance of a residential home or other structure. Additionally, the disclosed sleeve may protect the beam from further damage, including termite and/or weather damage.

In further embodiments, disclosed is a method of protecting and/or enhancing the appearance of a beam, the method comprising: providing a sleeve including an opening and a textured decorative outer surface; and inserting the beam into the sleeve through the opening of the sleeve, such that the sleeve fully covers the exposed surface area of the beam, the sleeve being a hollow, single piece encasement that conforms to the exposed surface area of the beam.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

Wooden beams are often incorporated into a structure, such as a home, to enhance its appearance. However, while fresh wood may have an aesthetic appeal, wood material may tend to wear and/or rot over time. This may be due, for example, to environmental exposure, harsh weather conditions, termite damage, etc. The degraded appearance of such worn and/or rotted the wooden beam(s) may negatively affect the exterior appearance of the home and lower its curb appeal. To address the above mentioned problems, the disclosed subject matter provides a decorative and/or protective sleeve 10, which may be used to cover a beam 12.

Figure 4:
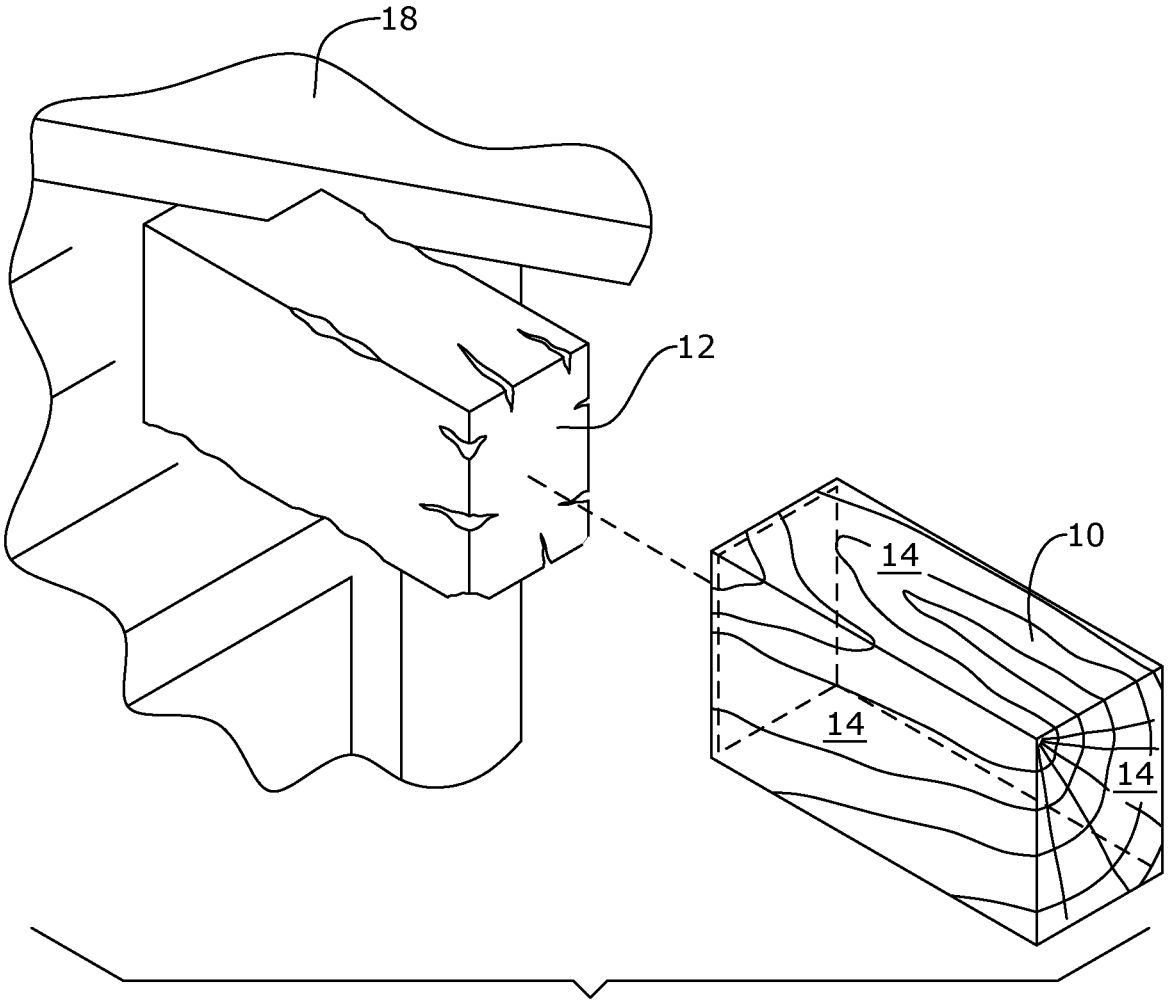
FIG. 4 is an exploded view of the decorative sleeve of FIG. 1.

In certain embodiments as depicted in FIG. 4, beam 12 may be a wooden beam. In some further embodiments, beam 12 may be an exterior component of a residential house 18 or other building structure and may be a structurally necessary or unnecessary structural component thereof. In some embodiments, beam 12 may be a part of the roof of house 18 as depicted in the figures. However, in other embodiments, beam 12 may be a component of another part of the house or other building structure, such as a porch, stairway, window, commercial building, etc. In some alternate embodiments, beam 12 may be a component of an exterior structure that is unattached but related to the house or building structure, such as a fence, gate, mailbox, and the like. In some other alternate embodiments, beam 12 may be an interior component of the house/building structure. In certain embodiments, beam 12 may be a rectangular beam, of various sizes. For example, beam 12 may have dimensions of about 4 inches by about 10 inches by about 8 inches, or about 4 inches by about 12 inches by about 8 inches, or about 4 inches by about 14 inches by about 8 inches, or about 6 inches by about 10 inches by about 8 inches, or about 6 inches by about 12 inches by about 8 inches, or about 6 inches by about 14 inches by about eight inches. It shall be appreciated that the size and geometric configuration for beam 12 may vary in different embodiments.

Figure 1:
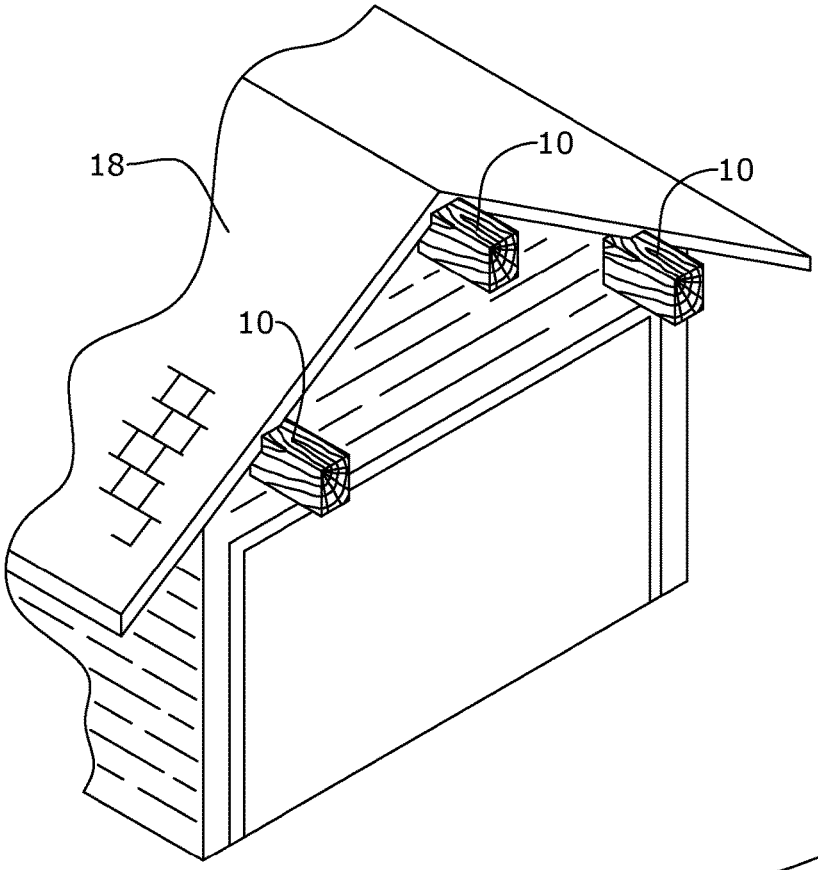
FIG. 1 is a perspective view of a decorative sleeve in accordance with certain embodiments, shown in use.
Figure 2:
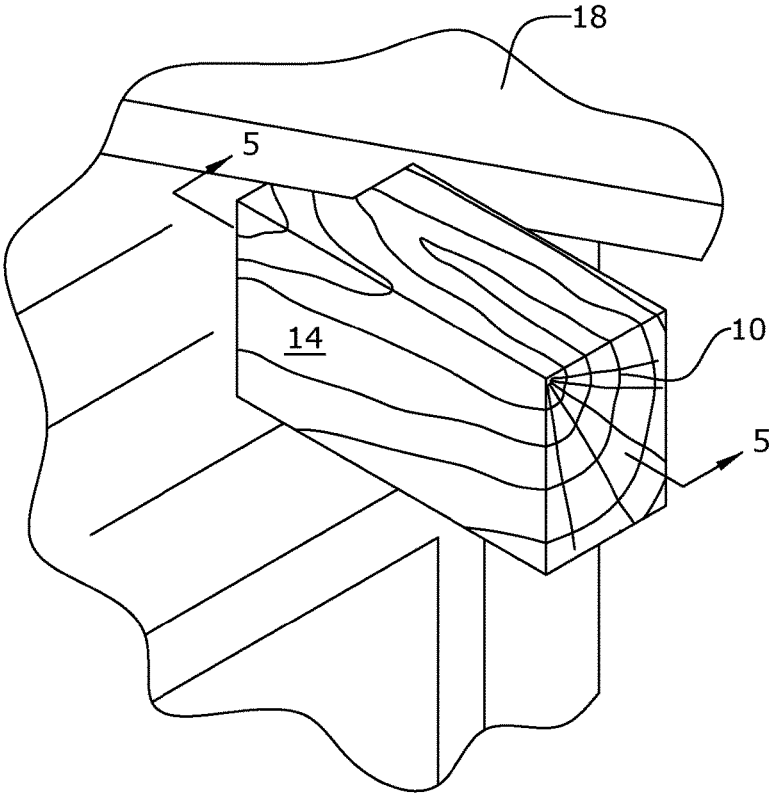
FIG. 2 is an enlarged perspective view of the decorative sleeve of FIG. 1.
Figure 3:
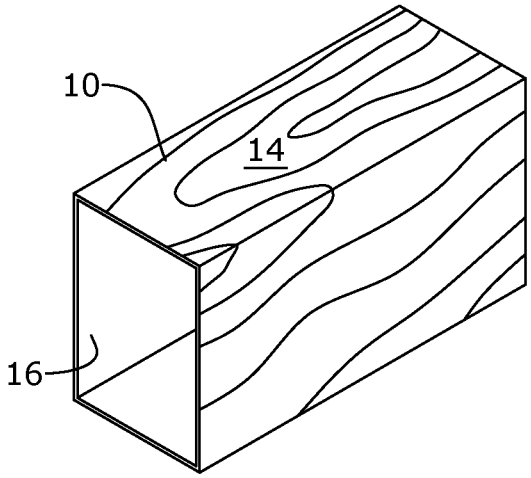
FIG. 3 is a rear perspective view of the decorative sleeve of FIG. 1.

In certain embodiments, as best depicted in FIGS. 1-4, sleeve 10 may have a faux wood surface texture 14. As shown in FIG. 3, sleeve 10 may be a hollow encasement or tube, provided with an opening 16, through which beam 12 may be inserted (see FIG. 5). In embodiments, the geometric configuration of sleeve 10 is designed to conform to the exposed or visually exposed surface area of the beam, and to snuggly fit over and cover the beam. For example, sleeve 10 may be designed as a hollow rectangular tube with a rear side opening, for fitting over a rectangular beam as shown in the figures. In certain embodiments, sleeve 10 may include cutouts as needed to accommodate for other interfering structures. In certain embodiments, sleeve 10 may be configured to cover all or most of beam 12, such that its appearance integrates with the building structure, and cannot be visually detected as a separate covering over the beam. As such, sleeve 10 may enhance the appearance of beam 12 and provide it with a fresh wooden appearance. In further embodiments, sleeve 10 may be provided with other surface textures/appearances, such as brick, plaster, marble, granite, etc., and may have other geometric configurations for covering differently shaped structures.

In embodiments, sleeve 10 may be made of a waterproof material such as polyurethane or polyurethane composite and may be provided as a single piece component configured to cover the entire beam. It may further be manufactured utilizing a custom injection molding process, or other suitable manufacturing method. According to various embodiments, the sleeve may have a material thickness of roughly between about 1/10 inches to about 1/4 inches, or about 1/8 of an inch, though material thickness may vary without departing from the inventive concept.

Figure 5:
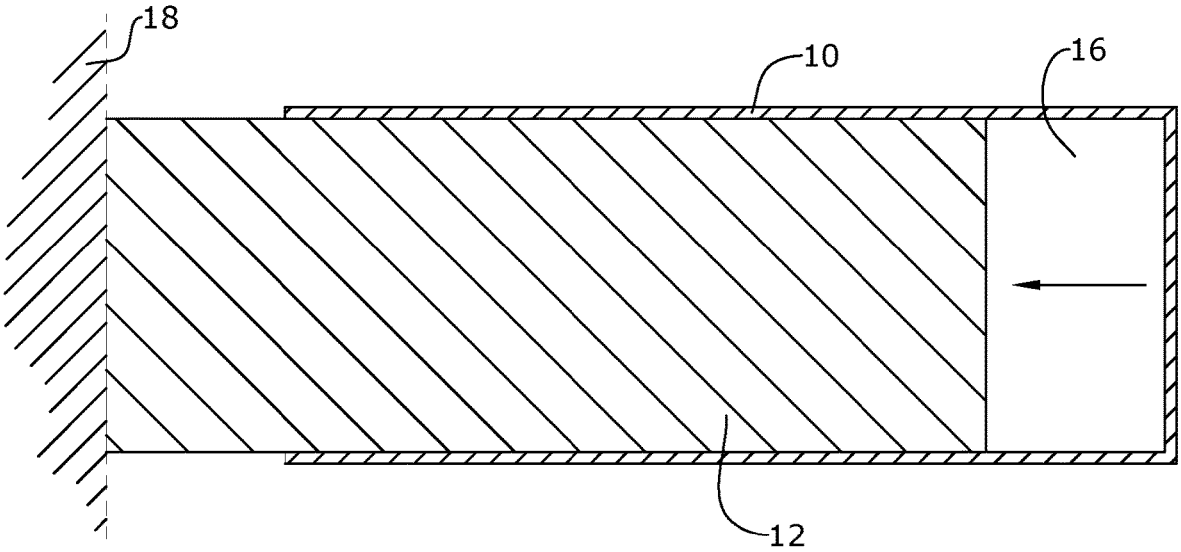
FIG. 5 is a section view of the decorative sleeve of FIG. 1, illustrating installation of the sleeve to a beam.
Figure 6:
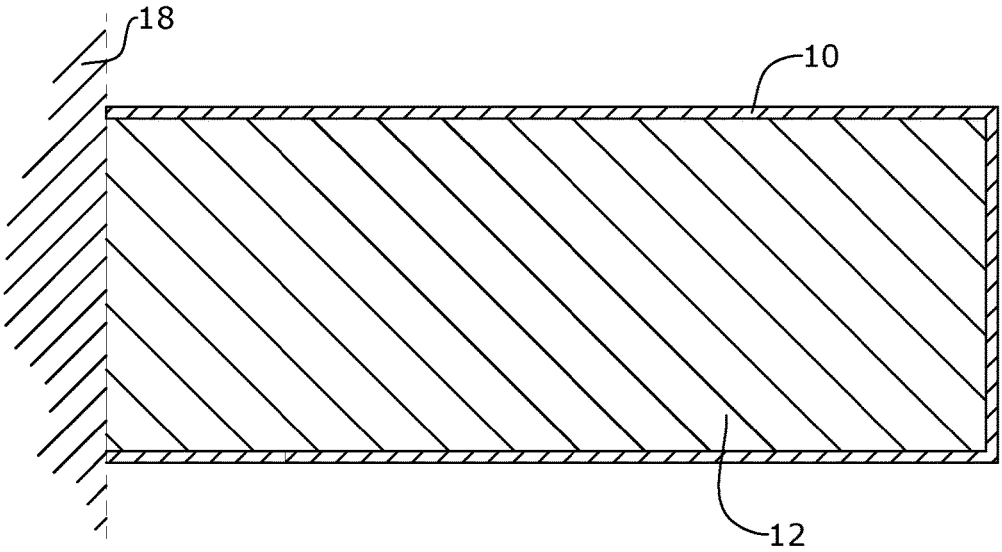
FIG. 6 is a section view, taken along line 6-6 from FIG. 2.

In embodiments, the sleeve may be installed by pulling it over beam 12 (see FIGS. 5 and 6). In certain embodiments, the sleeve may stay in place without adhesives or other attachment elements. In some embodiments, a fastener such as a waterproof screw or nail, may be used for added security and to ensure that the position of the sleeve does not shift with respect to the beam. In embodiments, the fastener may preferably be installed at the top of the beam/sleeve, such that it is hidden from view.

In some alternate embodiments, the disclosed sleeve may be used for covering other structures, such as a rail, fence, gate, etc. including interior or exterior structures, which may be a part of the house and/or yard. In some further embodiments, the sleeve may be used to create a wooden appearance for non-wooden structures. The sleeve may also be provided with other non-wooden exterior textures. In addition to providing an enhanced appearance, the disclosed sleeve may also be used to protect wood from damage, such as from termite or harsh weather.

It shall be appreciated that the disclosed sleeve can have multiple configurations in different embodiments. It shall be appreciated that the components of the sleeve described in several embodiments herein may comprise any alternative known materials in the field and be of any size and/or dimensions. It shall be appreciated that the components of sleeve described herein may be manufactured and assembled using any known techniques in the field.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A method of protecting or enhancing an appearance of a beam structure, the beam structure being a component of a building structure, the method consisting essentially of:

providing a sleeve including a sleeve rear opening on a rear side of the sleeve, the sleeve having a textured outer surface;

inserting the beam structure into the sleeve through the sleeve rear opening, such that the sleeve fully covers an exposed surface area of the beam structure and a perimeter of the sleeve rear opening directly contacts a wall of the building structure; and driving a nail or screw through the sleeve and the beam structure at a top side thereof to secure the sleeve to the beam structure, the sleeve being a hollow, single piece encasement that conforms to the exposed surface area of the beam structure, wherein a cross section of the sleeve and the sleeve rear opening have a common perimeter defining an outermost side boundary of the sleeve, wherein the perimeter of the sleeve rear opening does not include any peripheral flange projecting outwardly therefrom, and wherein the textured outer surface of the sleeve integrates with the wall of the building structure such that the sleeve is visually undetectable as a separate covering over the beam structure.

2. The method of claim 1, wherein the outer surface of the sleeve has a faux wood texture.

3. The method of claim 1, wherein the beam structure is rectangular, and sleeve is a rectangular tube, wherein the sleeve rear opening is rectangular.

4. The method of claim 1, wherein the sleeve is made of a waterproof material.

5. The method of claim 1, wherein the beam structure is a wooden beam.

6. The method of claim 1, wherein the beam structure is a non-wooden beam.

7. The method of claim 1, wherein the building structure comprises at least one of a home, porch, stairway, window, commercial building, or roof.

8. The method of claim 1, wherein a thickness of a material of the sleeve is between about 1/10 inches and 1/4 inches.

9. The method of claim 8, wherein the thickness of the material of the sleeve is about 1/8 inches.

* * * * *